US011345574B2

(12) United States Patent
Helenius et al.

(10) Patent No.: US 11,345,574 B2
(45) Date of Patent: May 31, 2022

(54) ELEVATOR DRIVE MACHINERY AND ELEVATOR

(71) Applicant: Kone Corporation, Helsinki (FI)

(72) Inventors: Juha Helenius, Helsinki (FI); Raimo Pelto-Huikko, Helsinki (FI)

(73) Assignee: Kone Corporation, Helsinki (FI)

( * ) Notice: Subject to any disclaimer, the term of this patent is extended or adjusted under 35 U.S.C. 154(b) by 237 days.

(21) Appl. No.: 16/458,700

(22) Filed: Jul. 1, 2019

(65) Prior Publication Data

US 2020/0071134 A1 Mar. 5, 2020

(30) Foreign Application Priority Data

Sep. 5, 2018 (EP) ..... 18192683

(51) Int. Cl.

| | |
|---|---|
| ***B66B 15/04*** | (2006.01) |
| ***B66B 7/10*** | (2006.01) |
| ***B66B 11/04*** | (2006.01) |
| ***B66B 11/08*** | (2006.01) |

(52) U.S. Cl.

CPC ..... *B66B 15/04* (2013.01); *B66B 7/10* (2013.01); *B66B 11/043* (2013.01); *B66B 11/08* (2013.01)

(58) Field of Classification Search

CPC ..... B66B 11/043; B66B 156/04

See application file for complete search history.

(56) References Cited

U.S. PATENT DOCUMENTS 185,276 A 12/1876 Andrews

FOREIGN PATENT DOCUMENTS

| | | | |
|---|---|---|---|
| DE | 859362 | C | 12/1952 |
| FI | 84803 | B | 10/1991 |
| JP | 2017197300 | A | 11/2017 |
| WO | WO-2016/096726 | A1 | 6/2016 |

OTHER PUBLICATIONS

Machine translation of DE 859362.*

Extended European Search Report dated Mar. 6, 2019, issued in corresponding European Patent Application No. 18192683.3.

* cited by examiner

*Primary Examiner* — Diem M Tran

(74) *Attorney, Agent, or Firm* — Harness, Dickey & Pierce, P.L.C.

(57) ABSTRACT

The invention relates to a drive machinery for an elevator, the drive machinery comprising a rotatable drive sheave for driving plurality of ropes of the elevator, and a motor for rotating the drive sheave; the drive sheave comprising a drive sheave body rotatable around a rotational axis; and plurality of rim arrangements mounted on the drive sheave body side by side in direction of said rotational axis, each said rim arrangement defining a circular outer rim for transmitting traction to a rope, said circular outer rims being coaxial with each other. The diameter of the circular outer rim of one or more of said rim arrangements is individually adjustable for enlarging or reducing the turning radius of a rope passing around the circular outer rim in question. The invention also relates to an elevator comprising said drive machinery.

13 Claims, 10 Drawing Sheets

ELEVATOR DRIVE MACHINERY AND ELEVATOR

RELATED APPLICATIONS

This application claims priority to European Patent Application No. 18192683.3 filed on Sep. 5, 2018, the entire contents of which are incorporated herein by reference.

FIELD OF THE INVENTION

The invention relates to an elevator drive machinery and an elevator utilizing the drive machinery. The elevator is preferably an elevator for transporting passengers and/or goods.

BACKGROUND OF THE INVENTION

Elevators typically comprise a drive sheave and a roping comprising ropes connected with the elevator car and passing around the drive sheave. Via the ropes, traction force can be transmitted from the drive sheave to the car. Thereby, car movement can be achieved and controlled by the drive sheave. The drive sheave can be rotatable by an electric motor, for example.

The ropes driven by the drive sheave are typically connected on one side of the drive sheave with the elevator car and on the other side with a counterweight.

Traction sheave elevators are prone to having more or less uneven rope forces. Ideally, parallel ropes would have equal forces, but in practice rope force differences exist in the elevator due to non-idealities, such as rope thickness variation, rope stiffness variation, rope coating thickness variation or rope groove diameter variation. If there are differences in the turning diameter (e.g. the pitch diameter) of ropes of an elevator, the ropes will experience travel differences as the elevator is run. This will generate unevenness in forces of parallel ropes.

Especially high friction ropes, such as ropes having a polymer coating, are easily subjected to large force variations due to their small slip on the drive sheave. Large rope force variations occurring on every roundtrip cause excessive fatigue loads on load bearing components, such as rope fixings, ropes themselves and guide shoes. They also cause ride comfort problems, increase pulley wear rate and reduce rope lifetime. Problems of rope force variation may also be faced with ropes engaging with positive engagement with the drive sheave.

There are known solutions for equalizing rope tensions of individual ropes of a roping, where there are rope tension equalizers at the rope ends. Such a solution has been presented in document F184803B, for example. Another known solution is to fix the rope ends via spring members so that the forces are transmitted from the rope to the fixing base via a spring enabling movement of the rope end relative to the fixing base. A drawback of these known solutions is that they allow only very limited range of movement of the rope ends. When an end of the range is reached, rope forces cannot be equalized further.

It has been noticed that with high friction ropes, such as ropes having a polymer coating, there is little or virtually no slip between ropes and the traction sheave, so the travel differences are hardly compensated by slip unlike in the case of steel ropes. When the travel differences are not compensated, ropes having different free lengths have to be elongated to the same length between hitch plate and traction sheave. Different elongations cause uneven rope forces especially when the car or the counterweight is approaching the top of the hoistway, because in this case suspension ropes are short and their stiffness is high.

It has also been noticed that rope travel differences are prone to accumulate with each rotation of the traction sheave. Long travel distance of the elevator, small traction sheave and 2:1 suspension increase the number of rotations of the sheave and worsen the problem. The lower is the headroom, the shorter and stiffer are the suspension ropes as the car or the counterweight is at the top of the hoistway.

It has therefore been noticed a drawback that the ability of prior solutions to equalize tension is the most problematic in elevators which have one or more of the following: long travel distance, low amount of slip, small diameter of the traction sheave and 2:1 suspension, low head room.

BRIEF DESCRIPTION OF THE INVENTION

The object of the invention is to provide a solution which is improved in terms of rope tension equalization of elevator ropes to be driven by a drive machinery. An object is particularly to alleviate one or more of the above defined drawbacks of prior art and/or problems discussed or implied elsewhere in the description. Solutions are presented, inter alia, by which an elevator can be achieved which has reduced variation of tension between individual ropes. Solutions are presented, inter alia, whereby this can be achieved even though the elevator has one or plurality of the following: long travel distance, low amount of slip, small diameter of the traction sheave and 2:1 suspension, low head room.

It is brought forward a new drive machinery for an elevator, the drive machinery comprising a rotatable drive sheave for driving plurality of ropes of the elevator, and a motor for rotating the drive sheave; the drive sheave comprising a drive sheave body rotatable around a rotational axis; and a plurality of rim arrangements mounted on the drive sheave body side by side in direction of said rotational axis, each said rim arrangement defining a circular outer rim for transmitting traction to a rope, in particular on which circular outer rim a rope can be placed to rest, said circular outer rims being coaxial with each other. The diameter of the circular outer rim of one or more of said rim arrangements is individually adjustable (i.e. without changing diameters of the rims of the other rim arrangements) for enlarging or reducing the turning radius of a rope passing around the circular outer rim in question.

With this solution, it is possible to adjust the speed of a particular rope relative to the other ropes of the elevator by which speed the rope passes around the drive sheave from one side of it to the other side of it. With the solution described, a tension difference, such as a tension difference generated by car position change, between said particular rope and other ropes, can be eliminated.

With this solution, one or more of the above mentioned advantages and/or objectives are achieved. Preferable further features are introduced in the following, which further features can be combined with the drive machinery individually or in any combination.

In a preferred embodiment, the rim members of the rim arrangements are at least substantially unrotatable around the rotational axis relative to the drive sheave body.

In a preferred embodiment, the circular outer rims of said rim arrangements are at least substantially unrotatable around the rotational axis relative to each other.

In a preferred embodiment, the drive sheave body 3 and the plurality of rim arrangements are connected to each other such that they are all together rotatable by the motor m around said rotational axis.

In a preferred embodiment, the individually adjustable diameter is individually adjustable to become greater relative to the diameters of the circular outer rims of the other rim arrangements and/or to become smaller relative to the diameters of the circular outer rims of the other rim arrangements.

In a preferred embodiment, the individually adjustable diameter is individually adjustable to become greater than diameters of the circular outer rims of all the other rim arrangements and/or to become smaller than diameters of the circular outer rims of all the other rim arrangements.

In a preferred embodiment, each said rim arrangement is suitable for transmitting traction to only one rope.

In a preferred embodiment, said adjustability is possible during rotation of the drive sheave. That is, the diameter of the circular outer rim of one or more of said rim arrangements is individually adjustable for enlarging or reducing the turning radius of a rope passing around the circular outer rim in question during rotation of the drive sheave.

In a preferred embodiment, each said rim arrangement comprises a single rim member defining said circular outer rim or more than one rim members together defining said circular outer rim.

In a preferred embodiment, said drive sheave moreover comprises an adjusting means for individually adjusting (i.e. without changing diameters of the rims of the other rim arrangements) the diameter of the circular outer rim of each of the one or more adjustable rim arrangements.

In a preferred embodiment, the motor for rotating the drive sheave is connected with the drive sheave body, preferably directly or via transmission, such that the motor can rotate the drive sheave body. The drive sheave body is preferably either directly fixed to or integral with the rotor of the motor. Alternatively, there could be a force transmission, such as gears, between the motor and the drive sheave body.

In a preferred embodiment, said adjusting means are mounted on the drive sheave body such that they are rotatable together with the drive sheave body around said rotational axis.

In a preferred embodiment, said adjusting means are electrically controllable. Said adjusting means are particularly preferably electrically controllable by an elevator control, which is configured to automatically control the motor for rotating the drive sheave of the machinery. Preferably, said adjusting means comprise an input for an electrical control signal. The adjusting means being electrically controllable gives freedom in selecting how the adjustment is performed as well as selecting based on which variables the adjustment is performed. An advantage is that the control of the adjusting means can be programmed to intelligently take into account any number of variables, analyze plurality of variables and compare variables freely. Preferably, control variables include rope tensions of individual ropes of the elevator.

In a preferred embodiment, said adjusting means are suitable for changing position of the rim member(s) (i.e. the aforementioned single rim member or more than one rim members together) defining said circular outer rim of an adjustable rim arrangement in radial direction of said rotational axis or at least the position of the circular outer rim defined by the rim member(s) in radial direction of said rotational axis.

In a preferred embodiment, the diameter adjustment is arranged to occur by aid of wedging. In a preferred embodiment, utilizing wedging, said adjusting means comprises, preferably per each said adjustable rim arrangement, a wedging means actuatable to wedge the rim member(s) (i.e. the aforementioned single rim member or more than one rim members together) defining said circular outer rim of an adjustable rim arrangement radially outwards from said rotational axis, as well as to release said wedging. Moreover, said adjusting means comprises an actuator for actuating the wedging means. Said adjusting means can comprise such an actuator per each said adjustable rim arrangement, or alternatively a shared actuator can be used for actuation of wedging means of more than one adjustable rim arrangement.

In a preferred embodiment utilizing wedging, said wedging means comprises at least one wedging member in radial direction between the rotational axis and a rim member of an adjustable rim arrangement, which wedging member is movable relative to the rim member forward for wedging the rim member radially outwards from said rotational axis, and backwards for releasing said wedging and for making way for the rim member to move radially towards said rotational axis, and the actuator is arranged to actuate movement of the wedging member forward and backwards.

In a preferred embodiment utilizing wedging, said wedging means comprises at least one wedging member in radial direction between the rotational axis and a rim member of an adjustable rim arrangement, which wedging member is movable relative to the rim member forward in direction of said rotational axis or in tangential direction of said rotational axis for wedging the rim member radially outwards from said rotational axis, and backwards in direction of said rotational axis or in tangential direction of said rotational axis for releasing said wedging and for making way for the rim member to move radially towards said rotational axis, and the actuator is arranged to actuate movement of the wedging member forward and backwards in direction of said rotational axis or in tangential direction of said rotational axis.

In a preferred embodiment utilizing wedging, said wedging member has a radially (in radial direction of the rotational axis) outer side portion which is slanted and movable against a radially (in radial direction of the rotational axis) inner side portion of the rim member for wedging the rim member radially outwards from said rotational axis.

In a preferred embodiment utilizing wedging, said rim member has a radially inner side portion which is slanted and faces the slanted radially outer side portion of the wedging member.

In a preferred embodiment utilizing wedging, said wedging member is ring shaped and surrounds the rotational axis. Thus, it can be used to wedge the rim member(s), were it a single or an array of them, evenly and with simple structure.

In a preferred embodiment utilizing wedging, said wedging member has a conical radially outer side.

In a preferred embodiment utilizing wedging, the aforementioned single rim member has a conical radially inner side, or the radially inner sides of the rim members of the array together define a conical shape.

In a preferred embodiment utilizing wedging, said actuator is an electric motor or a hydraulic cylinder.

In a preferred embodiment utilizing wedging, said actuator is an electric motor and rotation, such as speed and/or direction thereof, of the motor is electrically controllable.

In a preferred embodiment utilizing wedging, said actuator is connected via at least one drive member with the wedging means, in particular with a wedging member thereof.

In a preferred embodiment utilizing wedging, said actuator is a motor, such as an electric motor for example, and rotation of the motor in one direction is arranged to move the wedging member forward in first direction of said rotational axis, and rotation of the motor in another direction i.e. the opposite direction is arranged to move the wedging member backwards in second direction of said rotational axis.

In a preferred embodiment utilizing wedging, the wedging is caused by at least one wedging member. However, it is preferable that said adjusting means comprises two of said wedging members for acting on the same rim member. This is preferably implemented moreover such that the two wedging members have mutually opposite forward direction and backwards direction.

In a preferred embodiment utilizing wedging, the actuator, such as a motor or a hydraulic cylinder, can move the wedging member(s) by screwing.

In a preferred embodiment utilizing wedging, the at least one drive member comprises a screw member oriented in direction parallel with the rotational axis and the wedging member comprises an internal thread engaging with an external thread of the screw member.

In a preferred embodiment utilizing wedging, said adjusting means comprises two of said wedging members movable by the actuator in direction of said rotational axis simultaneously towards each other both simultaneously wedging the rim member radially outwards from said rotational axis and/or in direction of said rotational axis simultaneously away from each other both simultaneously releasing said wedging and making way for the rim member to move radially towards said rotational axis.

In a preferred embodiment utilizing wedging, each said rim member has a threaded radially inner side portion which is slanted and meshes with a threaded slanted radially outer side portion of the wedging member, and the wedging member is rotatable by the actuator relative to the rim member. The actuator can be a motor, such as an electric motor or a hydraulic cylinder for instance. However, preferably, the actuator is a hydraulic cylinder connected with the wedging means, in particular with the wedging member thereof. In this case, one of the extension and retraction of the hydraulic cylinder is arranged to rotate the wedging member relative to the rim member in one rotation direction and move it forward in direction of said rotational axis guided by the threaded engagement between the rim member and the wedging member thereby wedging the rim member radially outwards from said rotational axis. The other of the extension and retraction of the hydraulic cylinder is arranged to rotate the wedging member relative to the rim member in the other rotation direction and move the wedging member backwards in direction of said rotational axis guided by the threaded engagement between the rim member and the wedging member, thereby releasing said wedging and making way for the rim member to move radially towards said rotational axis.

In a preferred embodiment utilizing wedging, said adjusting means comprises two of said wedging members rotatable by the actuator relative to the rim member, as mentioned in the previous paragraph, which are movable in direction of said rotational axis simultaneously towards each other both simultaneously wedging the rim member radially outwards from said rotational axis and/or simultaneously away from each other both simultaneously releasing said wedging and making way for the rim member to move radially towards said rotational axis. Particularly, the slanted and threaded radially outer side portion of each of the wedging members then meshes with a slanted and threaded radially inner side portion of a rim member of the rim arrangement.

In a preferred embodiment, the diameter adjustment is arranged to occur by screwing. In a preferred embodiment, utilizing screwing, said adjusting means comprises, preferably per each said adjustable rim arrangement, a screwing means actuatable to push the rim member(s) (i.e. the aforementioned single rim member or more than one rim members together) defining said circular outer rim of an adjustable rim arrangement radially outwards from said rotational axis, as well as to release said push. Moreover, said adjusting means comprises an actuator for actuating the screwing means. Said adjusting means can comprise such an actuator per each said adjustable rim arrangement, or alternatively a shared actuator can be used for actuation of screwing means of more than one adjustable rim arrangement. Said actuator is preferably an electric motor. Then, preferably, rotation speed and/or rotation direction, of the motor is electrically controllable.

In a preferred embodiment utilizing screwing, the screwing means comprises one or more screws rotatable by said actuator. Preferably, each said screw is rotatable in two rotation directions by said actuator, most preferably around an axis extending in radial direction of the rotational axis of the drive sheave body.

In a preferred embodiment utilizing screwing, said actuator is arranged to rotate each said screw inside a threaded opening provided on the drive sheave body or an element mounted thereon in one rotation direction for pushing a rim member radially outwards from said rotational axis and in the other rotation direction for releasing said push and for making way for the rim member to move radially back towards said rotational axis of the drive sheave body.

In a preferred embodiment utilizing screwing, each said screw is arranged to push a rim member radially outwards from said rotational axis when rotated by the actuator in one rotation direction, and to release said push and make way for the rim member to move radially back towards said rotational axis X when rotated by the actuator in the other rotation direction.

In a preferred embodiment utilizing screwing, the actuator is arranged to rotate said one or more screws via a bevel gear mechanism.

In a preferred embodiment utilizing screwing, the rotational axis of the (actuator) motor is parallel with said rotational axis of the drive sheave body.

In a preferred embodiment, the diameter adjustment is arranged to occur by aid of hydraulics. In a preferred embodiment utilizing hydraulics, each of the rim member(s) (i.e. the aforementioned single rim member or more than one rim members together) defining said circular outer rim of an adjustable rim arrangement comprises at least one hydraulic chamber containing hydraulic fluid, and a radially outer wall, the radially outer wall in particular bordering the hydraulic chamber on the radially outer side thereof, the shape of which radially outer wall is elastically deformable, and the adjusting means comprises a pressure adjusting system, such as a pressure adjusting system containing a hydraulic pressurizing device (e.g. a hydraulic pump or a hydraulic cylinder), for adjusting fluid pressure, in particular increase or relieve the fluid pressure, in the hydraulic chamber, the pressure adjusting system being operable to increase the fluid pressure in the one or more hydraulic chambers such that the radially outer wall bulges radially outwards from said rotational axis, as well as to relieve said pressure, in particular such that the radially outer wall retracts from a bulging state radially back towards said rotational axis.

In a preferred embodiment utilizing hydraulics, each of the rim member(s) (i.e. the aforementioned single rim member or more than one rim members together) defining said circular outer rim of an adjustable rim arrangement comprises plurality of hydraulic chambers containing hydraulic fluid, and a radially outer wall, the radially outer wall in particular bordering the hydraulic chamber on the radially outer side thereof, the shape of which radially outer wall is elastically deformable, and the adjusting means comprises a pressure adjusting system, such as a pressure adjusting system comprising a hydraulic pressurizing device (e.g. a hydraulic pump or a hydraulic cylinder), for adjusting fluid pressures in the hydraulic chambers, the pressure adjusting system being operable to increase the fluid pressure in each of the hydraulic chambers such that the radially outer wall bulges radially outwards from said rotational axis, as well as to relieve said pressure, in particular such that the radially outer wall retracts from a bulging state radially back towards said rotational axis. Preferably, the plurality of hydraulic chambers are beside each other in direction of said rotational axis of the drive sheave body.

In a preferred embodiment utilizing hydraulics, the fluid pressures in the hydraulic chambers of the same rim member are adjustable to differ from each other.

In a preferred embodiment utilizing hydraulics, the pressure adjusting system comprises fluid channels separately connected with the hydraulic chambers of the rim member for enabling adjusting the fluid pressures in the hydraulic chambers of the rim member to differ from each other.

In a preferred embodiment utilizing hydraulics, fluid pressures in the plurality of hydraulic chambers are individually adjustable by the pressure adjusting system, i.e. the pressure adjusting system can adjust the fluid pressure, in particular increase or relieve the fluid pressure, in each of the hydraulic chambers of the rim member without changing fluid pressures in the other hydraulic chambers of the rim member.

It is also brought forward a new elevator comprising a drive machinery as defined anywhere above, and plurality of ropes arranged to pass around the drive sheave thereof, in particular each resting on an outer rim of one of the rim arrangements of the drive sheave. With this solution, one or more of the above mentioned advantages and/or objectives are achieved. Preferable further features are introduced in the following, as well as above in context of description of the drive machinery, which further features can be combined with the elevator individually or in any combination.

In a preferred embodiment, said rope comprises a coating forming the outer surface of the rope, wherein the coating is in contact with the outer rim of one of the rim arrangements of the drive sheave and the coating comprises polymer material.

In a preferred embodiment, the elevator comprises a tension sensing means for sensing individual tensions of one or more of the ropes, the elevator being arranged to adjust, preferably with the aforementioned adjusting means, the diameter of the circular outer rim of at least one adjustable rim arrangement based on the sensed individual tensions of one or more of the ropes.

In a preferred embodiment, the elevator is arranged to sense individual tensions of one or more of the ropes and compare the sensed individual tensions with one or more reference tensions and to adjust by said adjusting means the diameter of the circular outer rim of at least one adjustable rim arrangement based on the sensed individual tensions, in particular such that a difference between a measured tension and a reference tension is reduced.

In a preferred embodiment, said reference tension can comprises a preset tension or an average tension of measured individual tensions of plurality of ropes or a measured individual tensions of one of the other ropes of the elevator, for example.

In a preferred embodiment, the elevator comprises a hoistway, an elevator car vertically moveable in the hoistway, and an elevator control, which is configured to automatically control the motor of the machinery.

In a preferred embodiment, the maximal travel distance of the elevator car is preferably more than 100 meters, more preferably more than 200 meters, most preferably more than 300 meters.

In a preferred embodiment, each said rope is belt-shaped, i.e. substantially larger in width direction w than in thickness direction. The width/thickness ratio of the rope is then preferably more than 2.

In a preferred embodiment, each said rope is a flat belt or the rope has tooth pattern engaging counterpart tooth pattern of the outer rim of a circular rim member of the drive sheave, or the rope comprises a rib pattern of ribs parallel to longitudinal direction of the rope engaging counterpart rib pattern of the outer rim of a circular rim member of the drive sheave.

In a preferred embodiment, said adjusting means are adjusting equipment.

The elevator is in general preferably such that it comprises an elevator car vertically movable to and from plurality of landings, i.e. two or more vertically displaced landings. Preferably, the elevator car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
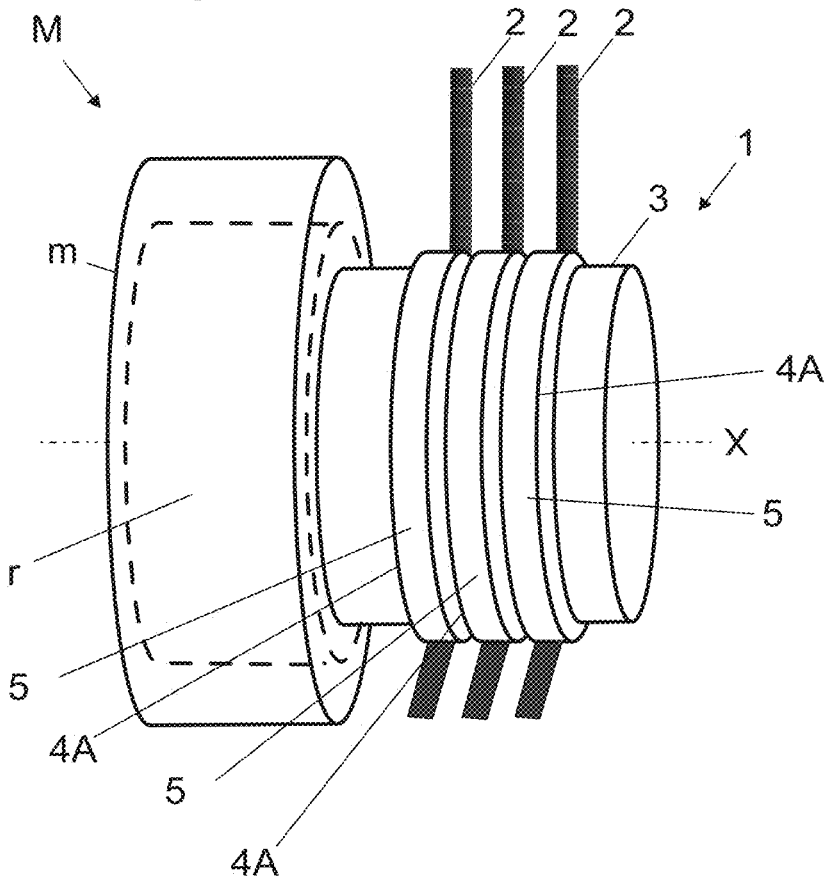
FIG. 1 illustrates a drive machinery for an elevator according to a preferred embodiment.

FIG. 1 illustrates a drive machinery M for an elevator according to a preferred embodiment. The drive machinery M comprises a rotatable drive sheave 1 for driving plurality of ropes 2 of the elevator, and a motor m for rotating the drive sheave 1. The motor m is preferably an electric motor. The drive sheave 1 comprises a drive sheave body 3 rotatable around a rotational axis X. The drive sheave 1 moreover comprises a plurality of rim arrangements 4A mounted on the drive sheave body 3 side by side in direction of said rotational axis X, each said rim arrangement 4A defining a circular outer rim 5 for transmitting traction to a rope 2, and on which circular outer rim 5 a rope can be placed to rest. The outer rims 5 of the rim arrangements 4A are coaxial with each other. Said rotational axis X is a rotational axis of the circular outer rims 5.

The drive machinery M is suitable for exerting traction via the rim arrangements 4A on the ropes 2 passing around them. In FIG. 1, the drive sheave 1 is arranged to exert traction via the rim arrangements 4A on the ropes 2 passing around them.

The drive sheave body 3 and the plurality of rim arrangements 4A are connected to each other such that they are all together rotatable by the motor m around said rotational axis X.

Figure 2:
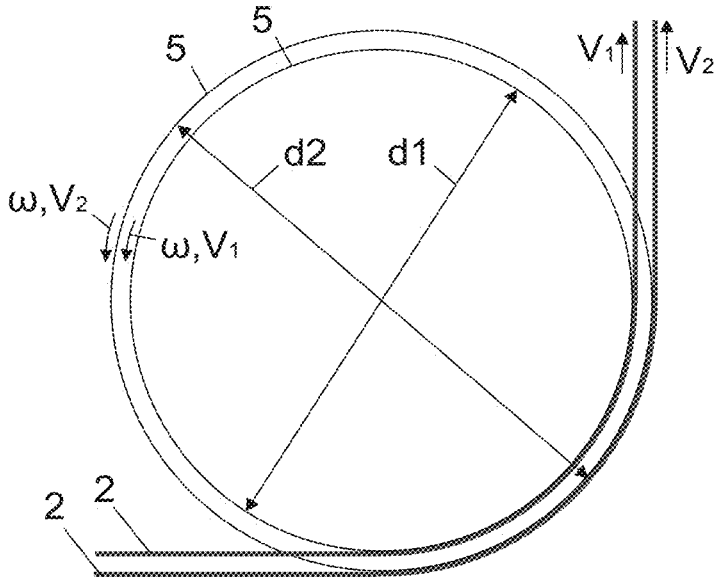
FIG. 2 illustrates a schematically adjustability of an adjustable rim arrangement of FIG. 1 as seen in direction of the rotational axis of the drive sheave.

As schematically illustrated in FIG. 2, the diameter of the rim 5 of one or more of said rim arrangements 4A is individually (i.e. without changing diameters of the rims 5 of the other rim arrangements 4A) adjustable for enlarging or reducing the turning radius of a rope 2 passing around the rim 5 in question. The rim arrangements 4A, the outer rim diameter of which are individually adjustable, are also referred to by using term individually adjustable rim arrangements and term adjustable rim arrangements.

Preferably, said rim members 4 are completely or at least substantially unrotatable around the rotational axis X relative to the drive sheave body 3. When no considerable relative rotation can occur between the rim members 4 and the drive sheave body 3, these can all be effectively rotated together. Here, by term substantially unrotatable it is meant that the rim arrangements 4A in question cannot rotate around the rotational axis X relative to the drive sheave body 3 more than 10 degrees.

Preferably, the circular outer rims 5 of said rim arrangements 4A are completely or at least substantially unrotatable around the rotational axis X relative to each other. When no considerable relative rotation can occur between the circular outer rims 5, rope tensions cannot be equalized effectively by relative rotation between the circular outer rims 5. In this context, the diameter adjustment is particularly advantageous. Here, by term substantially unrotatable it is meant that the rim arrangements 4A in question cannot rotate around the rotational axis X relative each other more than 10 degrees.

The individually adjustable diameter is particularly individually adjustable to become greater relative to the diameters of the circular outer rims 5 of the other rim arrangements 4A and/or to become smaller relative to the diameters of the circular outer rims 5 of the other rim arrangements 4A. It is moreover preferable that the individually adjustable diameter is individually adjustable to become greater than diameters of the circular outer rims 5 of all the other rim arrangements 4A of the drive sheave 1 and/or to become smaller than diameters of the circular outer rims 5 of all the other rim arrangements 4A of the drive sheave 1. Thus, the speed of a rope 2 passing around the circular outer rim 5 that is in this way individually adjustable, can be made to be the highest within the roping formed by the ropes 2 or the lowest within the roping formed by the ropes 2. Hereby, the tension of the rope 2 passing around the circular outer rim 5 in question can be affected quickly and individually. It is also preferable that the diameters of the circular outer rims 5 of the adjustable rim arrangements 4A are adjustable to become the same with each other, and preferably also the same as the diameters of the circular outer rims 5 of the rim arrangements 4A the diameters of which are not adjustable, if such exist. Hereby, all the circular outer rims 5 of the drive sheave 1 can be made to have the same diameter, which is a well working starting point for a new elevator being installed.

FIG. 2 shows how the path of the rope 2 changes when the diameter of the outer rim 5 of a rim arrangement 4A is changed between d1 and d2. When with a given angular speed co, the diameter is increased from d1 to d2, the tangential speed is increased from V1 to V2. This means that the speed of the rope 2 passing around the outer rim 5 in question is increased from V1 to V2. When this kind of adjustment is made for an individual outer rim 5, the speed of the individual rope 2 passing around it is increased relative to other ropes of the system, when diameters of the rims 5 around which they travel are not also increased. Correspondingly, by reduction of the diameter of the outer rim 5, the speed of the rope 2 passing around it can be reduced. An advantage is that the tension values of the rope 2 in question existing on opposite sides of the drive sheave 1 can be brought towards the tension values of the other ropes existing on opposite sides of the drive sheave 1. Thus, by individual rim diameter adjustment rope tension variations generated during car movement (e.g. due to non-idealities existing in the elevator structures) can be reduced. This alleviates tension problems in the elevator system.

In the preferred embodiment, each said rim arrangement 4A is suitable for transmitting traction to only one rope 2. This facilitates that the tension adjustment can be focused on only one rope.

Figure 3:
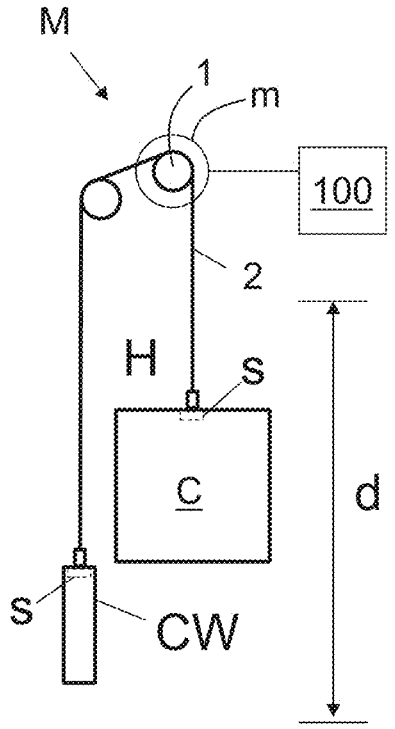
FIG. 3 illustrates an embodiment of an elevator implementing the drive machinery of FIG. 1.

FIG. 3 illustrates a preferred embodiment of an elevator according to the invention. The elevator comprises a drive machinery M as described above and plurality of ropes 2 arranged to pass around the drive sheave 1 thereof.

The elevator comprises a hoistway H, and an elevator car C vertically moveable in the hoistway H, and an elevator control 100, which is configured to automatically control the motor m of the machinery M. The elevator comprises plurality of ropes 2 passing around the drive sheave 1, each resting on an outer rim 5 of one or the rim arrangements 4A of the drive sheave 1.

The elevator moreover comprises a counterweight CW and the ropes 2 interconnect the car C and counterweight CW. The drive sheave 1 engages the section of each rope 2 extending between the car C and counterweight CW.

The maximal travel distance d of the elevator car C, that is the distance between the uppermost position and the lowermost position of the car C during elevator use to serve passengers, which are realized when the car C (in particular the sill thereof) is level with the uppermost landing (in particular the sill thereof) where the car C can be driven and when the car C (in particular the sill thereof) is level with the lowermost landing (in particular the sill thereof) where the car C can be driven, respectively, is preferably more than 100 meters, more preferably more than 200 meters, possibly more than 300 meters, because the longer the travel distance, the more advantageous the solution is.

Figure 4:
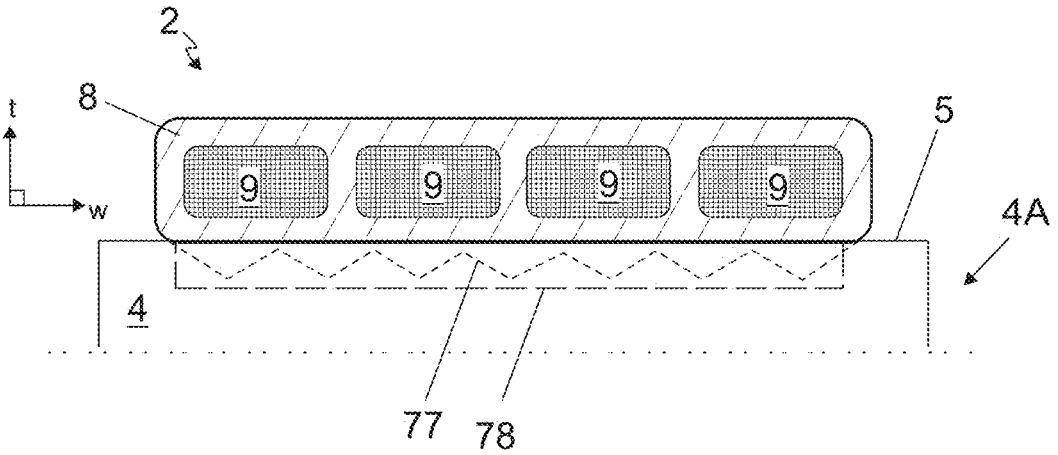
FIG. 4 illustrates preferred details of the rope utilized in combination with the drive machinery of FIG. 1.

FIG. 4 illustrates preferred details of the rope 2. In this case, the rope 2 is such that it can rest on an outer rim 5 of one of the rim arrangements 4A of the drive sheave 1 such that little or virtually no slip can occur between the rope 2 and the outer rim 5 of the drive sheave 1. In the embodiment illustrated, this is due to the rope 2 comprising an outer surface material comprising polymer. More specifically, in the presented embodiment, the rope 2 comprises load bearing members 9 extending in longitudinal direction of the rope 2 throughout the length thereof and embedded in a coating 8 forming the outer surface of the rope 2. The coating 8 comprises polymer material such as polyurethane for example, or alternatively rubber or silicone. The coating 8 is in contact with the outer rim 5 of a rim member 4 of one of the rim arrangements 4A of the drive sheave 1. The rope 2 is moreover belt-shaped, i.e. substantially larger in width direction w than in thickness direction t, which increases firmness of engagement between it and the drive sheave 1. This rope-shape thereby in its part reduces likelihood of slip between the rope 2 and the outer rim 5 of the drive sheave 1, and thereby the presented solution is advantageous with this kind of rope 2. The belt can be a flat belt, for example. Likelihood of slip is even lower if the rope 2 has tooth pattern engaging counterpart tooth pattern of the outer rim 5 of a rim member 4 of the drive sheave 1, or if the rope 2 comprises a rib pattern of ribs parallel to longitudinal direction of the rope engaging counterpart rib pattern of the outer rim 5 of a rim member 4 of the drive sheave 1, said alternative and optional patterns being presented in FIG. 4 in broken lines 77 and 78. At least some of the advantages of the invention can be achieved also with other shapes and materials of the rope 2, such as with ropes having round cross-section and comprising an outer surface material comprising polymer. The invention may be advantageous also with an uncoated steel rope passing around an uncoated drive sheave. In this kind of context, the tension differences between ropes do not tend to rise very high due to slip. However, slip may cause wear on the ropes and the drive sheave. By reducing tension differences, the invention can also be used to reduce slip and thereby increase service life of an uncoated steel rope and an uncoated drive sheave.

Figure 5:
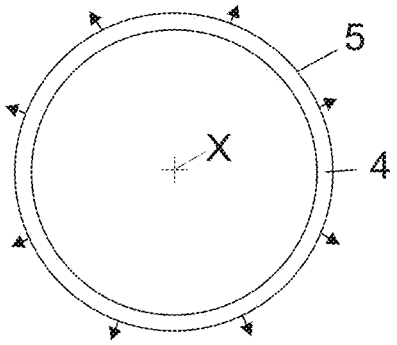
FIGS. 5 and 6 illustrate different ways to form a circular outer rim of an adjustable rim arrangement of FIG. 1.
Figure 6:
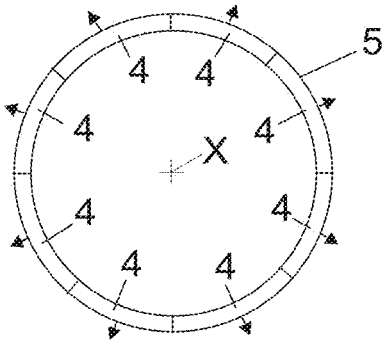

FIGS. 5 and 6 illustrates different ways to form the circular outer rim 5. These Figures each discloses schematically how said adjusting means 10,20,30,40,40,50,60 are suitable for changing position of the rim member(s) 4 or at least the position of the circular outer rim 5 defined by it/them in radial direction of said rotational axis X. These Figures each discloses a schematic cross sectional view of the parts of a rim arrangement 4A defining the circular outer rim 5. In the solution presented in FIG. 5, the rim arrangement 4A comprises a single rim member defining said circular outer rim 5. In this case, the one rim member 4 defining said circular outer rim 5 is deformable to have different diameters, which can be implemented by resilient material and/or structure. The change of diameter need not be necessarily large in the adjustment, so even slight deformability of the rim member 4 can be sufficient, depending on the case. The material can be some composite material or plastic material, for instance. Anyway, should the material of the rim member 4 be of a very rigid material such as metal, the structure is preferable to design to have thin material thickness such that the deformation is achievable without very high forces and without departing from elastic nature of the deformation. In the solution presented in FIG. 6, the rim arrangement 4A comprises more than one rim members 4 defining together said circular outer rim 5. In this case plurality of rim members 4 together form an array of rim members 4 each defining a segment of said circular outer rim 5 for transmitting traction to a rope 2. In the embodiment of FIG. 6, the rim members 4 do not need to be deformable.

For the purpose of carrying out the adjusting of the diameters of the rims 5 of the adjustable rim arrangements 4A, said drive sheave 1 moreover comprises an adjusting means 10,20,30,40,50,60 for individually adjusting the diameter of the circular outer rim 5 of each of the adjustable rim arrangements 4A.

Figure 10:
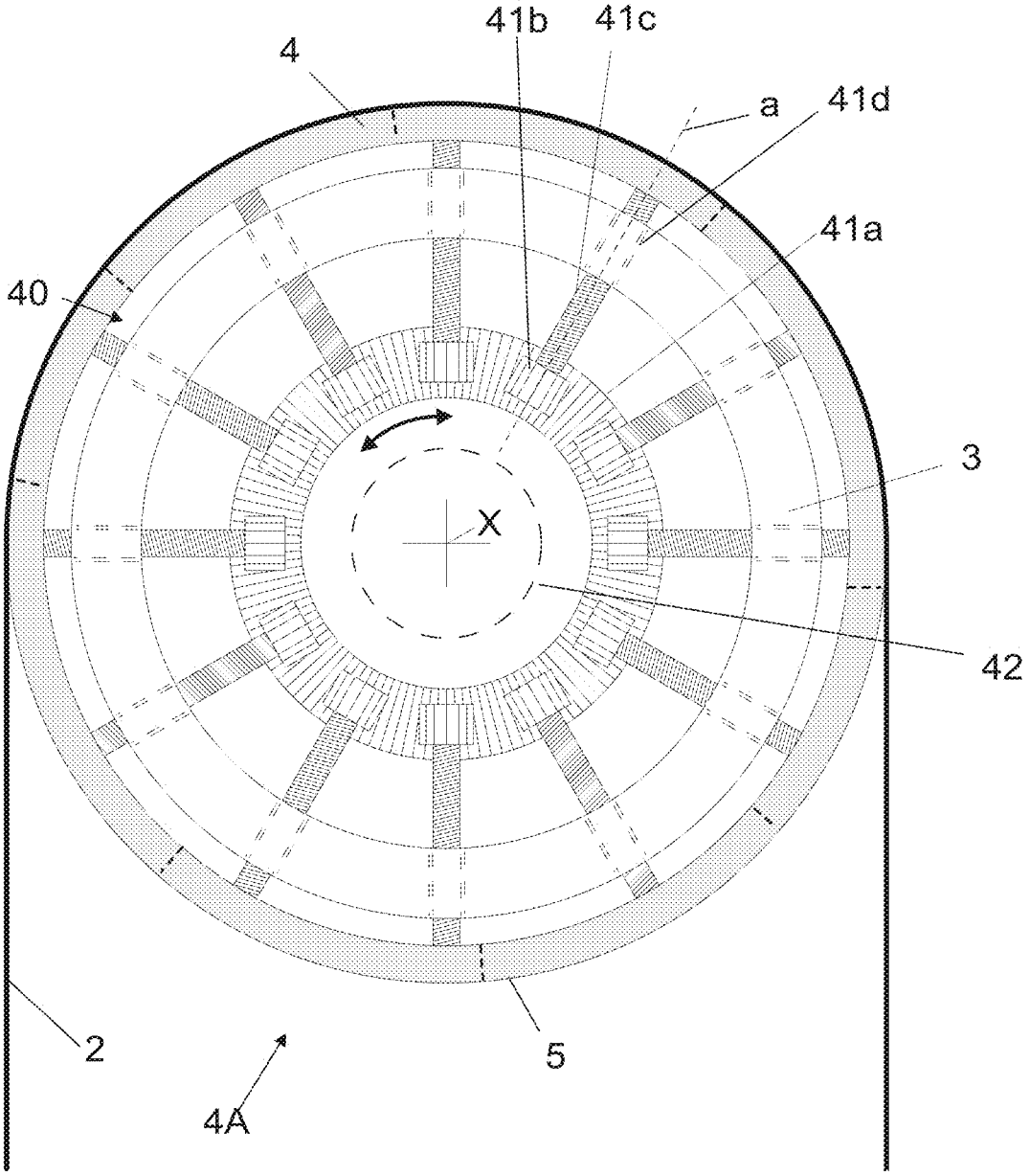
FIG. 10 illustrates preferred details of a fourth kind for the drive machinery of FIG. 1.

Said adjusting means 10,20,30,40,50,60 are preferably electrically controllable. Said adjusting means are particularly preferably electrically controllable by an elevator control, which is configured to automatically control the motor for rotating the drive sheave of the machinery. For this purpose, said adjusting means 10,20,30,40,50,60 comprise one or more inputs i for an electrical control signal. An elevator control 100 is illustrated in FIGS. 3 and 10.

Figure 7:
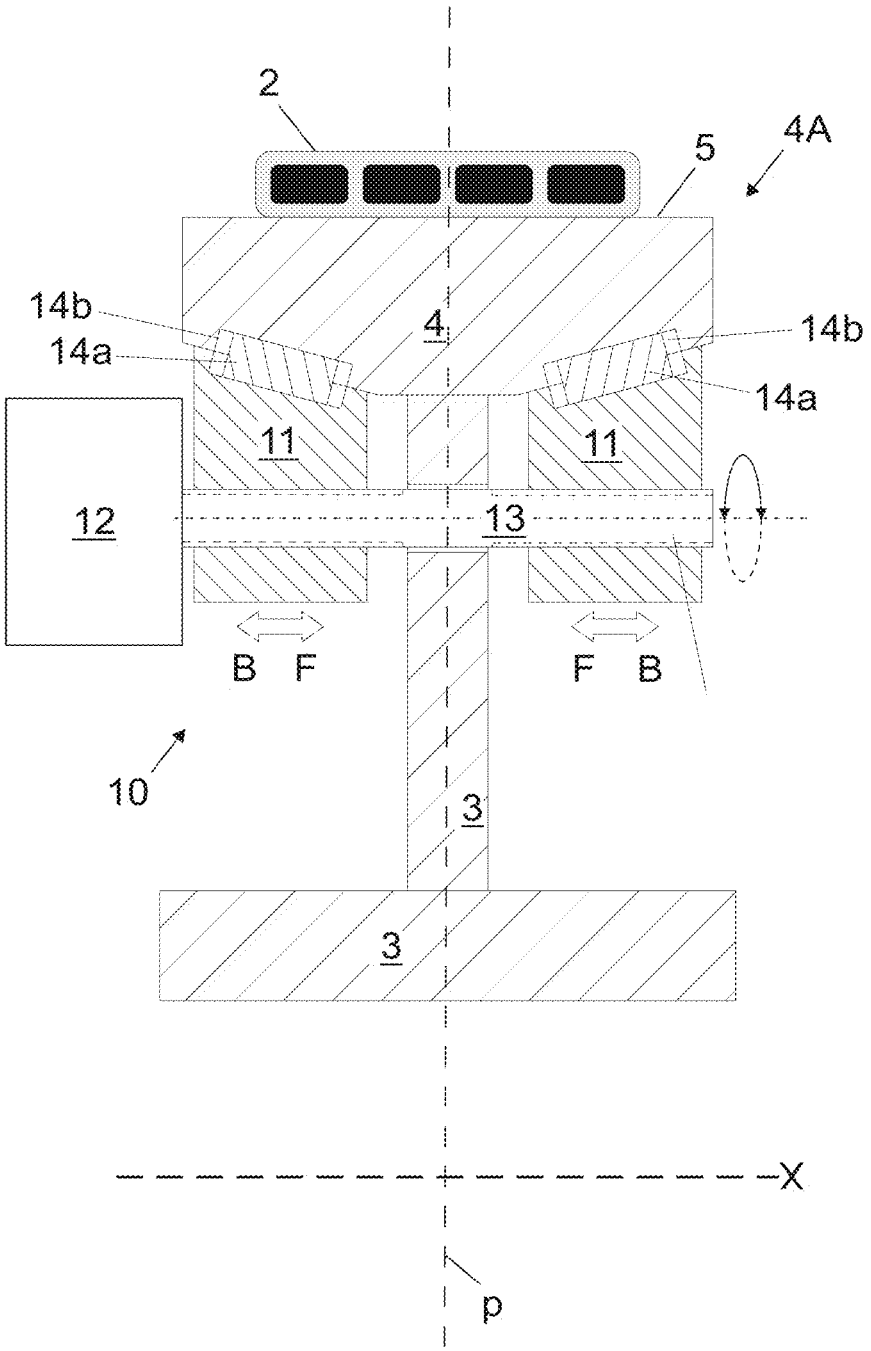
FIG. 7 illustrates preferred details of a first kind for the drive machinery of FIG. 1.
Figures 8A, 8B:
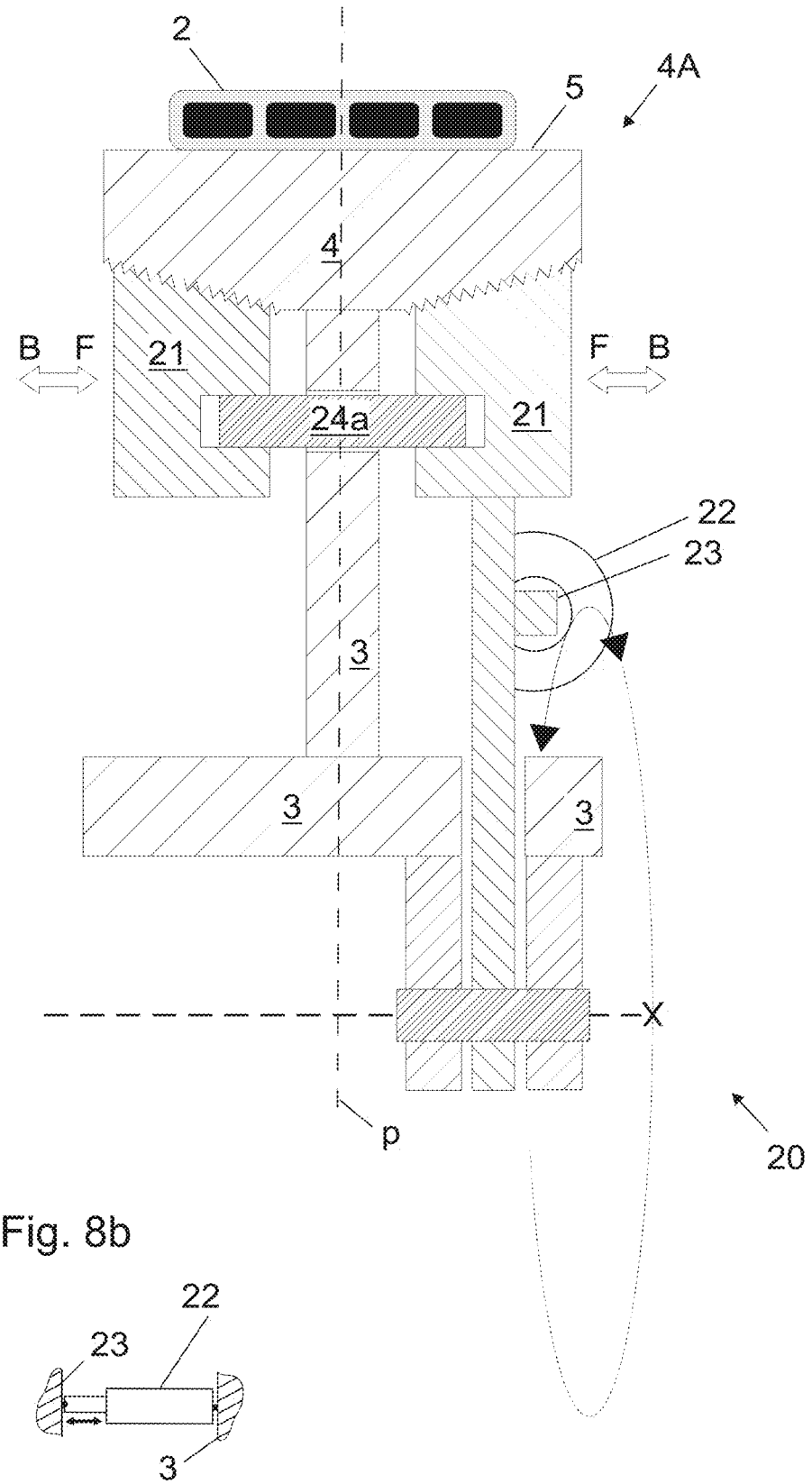
FIGS. 8*a* and 8*b* illustrates preferred details of a second kind for the drive machinery of FIG. 1.
Figure 9:
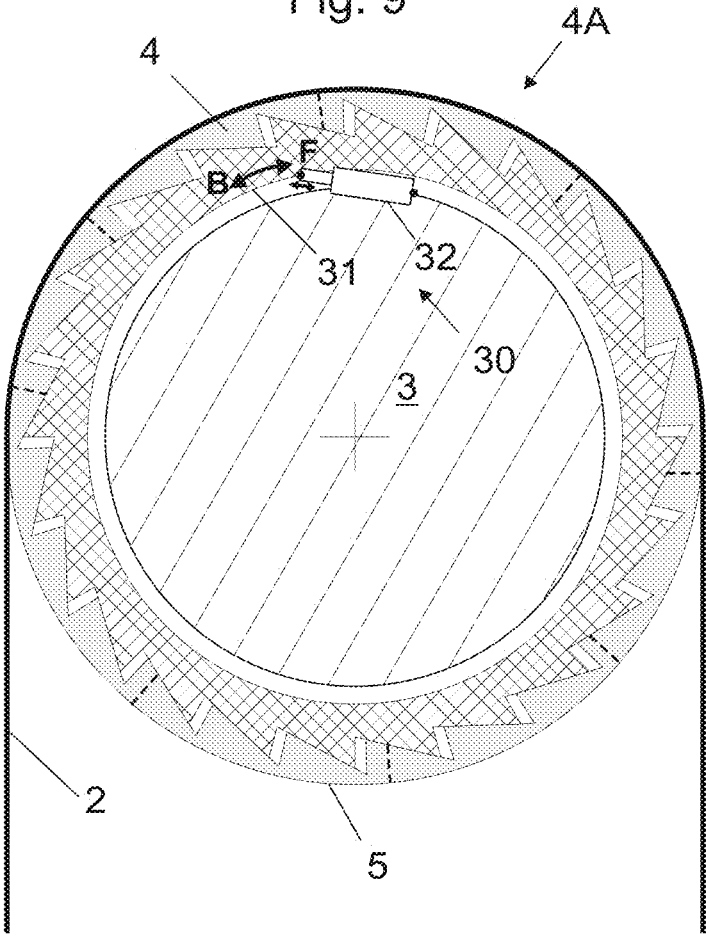
FIG. 9 illustrates preferred details of a third kind for the drive machinery of FIG. 1.

FIGS. 7-9 illustrate preferred alternative embodiments for implementing the diameter adjustment by aid of wedging. In these embodiments, said adjusting means 10,20,30 comprises a wedging means 11,21,31 actuatable to wedge the rim members 4 (i.e. the aforementioned single rim member 4 or more than one rim members 4, which alone or together define said circular outer rim 5) of an adjustable rim arrangement 4A radially outwards from said rotational axis X, as well as to release said wedging, and an actuator 12,22,32 for actuating the wedging means 11,21,31. The drive machinery M preferably comprises this kind of parts per each adjustable rim arrangement 4A.

In the embodiments of FIGS. 7-9, said wedging means 11,21,31 comprises a wedging member 11,21,31 positioned in radial direction between the rotational axis X and a rim member 4 of an adjustable rim arrangement 4A, which wedging member 11,21,31 is movable relative to the rim member 4 forward F for wedging the rim member 4 radially outwards from said rotational axis X, and backwards B for releasing said wedging and for making way for the rim member 4 to move radially towards said rotational axis X, and the actuator 12,22,32 is arranged to actuate movement of the wedging member 11,21,31 in forward and backwards direction F,B. These embodiments are different in that in the embodiments of FIGS. 7 and 8, said movement forward and backwards is oriented parallel with direction of said rotational axis X, and in the embodiment of FIG. 9 in tangential direction of said rotational axis X.

In the embodiments of FIGS. 7-9 said wedging member 11,21,31 has a radially (i.e. in radial direction of the rotational axis X) outer side portion which is slanted, in particular to have a first end and a second end displaced in direction of the rotational axis X, which ends are at a different distances from the rotational axis X, said wedging member 11,21,31 being movable against a radially (i.e. in radial direction of the rotational axis X) inner side of the rim member 4 for wedging the rim member 4 radially outwards from said rotational axis X.

In the embodiments of FIGS. 7 and 8*a*-8*b*, said rim member 4 has a radially inner side portion which faces the slanted radially outer side portion of the wedging member 11,21,31, and is also slanted, in particular to have a first end and a second end displaced in direction of the rotational axis X, which ends are at a different distances from the rotational axis X.

Said wedging member 11,21,31 is preferably ring-shaped and surrounds the rotational axis X. Thus, it can be used to wedge the rim members 4, were there a single or an array of them (cf. FIGS. 5 and 6), evenly and with simple structure.

In the embodiment of FIGS. 7 and 8*a*-8*b*, said wedging member 11,21 has a conical radially outer side. Likewise, said rim member 4 has a conical radially inner side, or the radially inner sides of the rim members 4 of the array, as described referring to FIG. 6, together define a conical shape.

In the embodiment of FIGS. 7 and 8*a*-8*b*, the above described wedging can be caused by at least one wedging member 11,21. However, it is preferable that there are two wedging members 11,21 for acting on the same the rim member 4. This is preferably implemented moreover such that the two wedging members 11,21 have mutually opposite forward F direction and backwards B direction. This facilitates compactness of the overall structure. Moreover, this provides that at least part of the forces counteract each other, which makes it more simple to provide reaction forces for the wedging. In the embodiments of FIGS. 7 and 8*a*-8*b*, the wedging is arranged to be caused by moving the two wedging members 11,21 closer to each other and released by moving the two wedging members 11,21 further apart.

In the embodiment of FIG. 7, said actuator 12 is a motor. Most preferably the motor is an electric motor, and rotation, preferably rotation speed and/or rotation direction, of the motor 12 is electrically controllable.

The actuator 12, which is here a motor, is connected via at least one drive member 13 with the wedging means 11, in particular with a wedging member 11 thereof. Rotation of the motor 12 in one direction is arranged to move the wedging member 12 forward F in direction of said rotation axis X, and rotation of the motor in another direction (i,e. the direction opposite to said one direction) is arranged to move the wedging member 11 backwards B in direction of said rotational axis X.

In the embodiment of FIG. 7, the actuator 12, i.e. the motor 12 can move the wedging member 11 by screwing. For this purpose, the aforementioned at least one drive member comprises a screw member 13 oriented in direction parallel with the rotation axis X, and the wedging member 11 comprises an internal thread engaging with an external thread of the screw member 13.

In the embodiment of FIG. 7, the adjustment is implemented using two wedging members 11. Particularly, said adjusting means 10 comprises two of said wedging members 11 movable by the actuator 12 in direction of said rotational axis X simultaneously towards each other both simultaneously wedging the rim member 4 radially outwards from said rotational axis X and/or in direction of said rotational axis X simultaneously away from each other both simultaneously releasing said wedging and making way for the rim member 4 to move radially towards said rotational axis X.

The slanted outer side portion of each of the wedging members 11 faces a slanted radially inner side of a rim member 4 of the adjustable rim arrangement 4A, and slanted portions of the rim members 4 acted on by the two wedging members 11 are mirror shaped with respect to the plane of rotation p of the drive sheave body 3 (the plane p in Figures to which the axis X is normal).

In the embodiment illustrated, the two wedging members 11 share a drive member, which is in the presented case a screw member 13 extending through them, and each of said two wedging members 11 comprises an internal thread engaging with an external thread of the screw member 13. The internal threads of the two wedging members 11 and the external threads of the screw member 13 are mirror shaped with respect to the plane of rotation p of the drive sheave body 3. Thus, by rotation of the screw member 13 in one rotation direction, the two wedging members 11 move towards each other (each moving in direction F), and by rotation of the screw member 13 in the other rotation direction, the two wedging members 11 move away from each other (each moving in direction B). Actuator 12 can be immovably mounted on the drive sheave body 3, for instance. It is however possible to mount it alternatively immovably on the wedging member 11 (either one in Figures), in which case the screw member 13 need not be in threaded engagement with both of the two wedging members 11.

In the embodiment of FIG. 7, the drive sheave 1 moreover comprises a blocking means 14*a*,14*b* for blocking relative rotation between the wedging member 11 and the circular rim member 4. In the illustrated embodiment, these blocking means 14*a*,14*b* comprise a blocking member 14*a* placed in a nest formed between the wedging member 11 and the rim member 4. The nest 14*b* is larger than the blocking member 14*a* for allowing relative movement between the wedging member 11 and the rim member 4 in direction of said rotational axis x in said wedging. Thus the blocking member 14*a* does not block the relative movement between the wedging member 11 and the rim member 4 in direction of said rotational axis x in said wedging.

In the embodiment illustrated in FIGS. 8*a* and 8*b*, the rim member 4 of the adjustable rim arrangement 4A has a threaded radially inner side portion which is slanted and meshes with a threaded slanted radially outer side portion of the wedging member 21, and the wedging member 21 is rotatable by the actuator 22 relative to the rim member 4.

In the embodiment illustrated in FIGS. 8*a* and 8*b*, the actuator 22 is a hydraulic cylinder connected with the wedging means 21, in particular with the wedging member 21 thereof. One of the extension and retraction of the hydraulic cylinder 22 is arranged to rotate the wedging member 21 relative to the rim member 4 in one rotation direction and move it forward F in direction of said rotational axis X guided by the threaded engagement between the rim member 4 and the wedging member 21 thereby wedging the rim member 4 radially outwards from said rotational axis X. The other of the extension and retraction of the hydraulic cylinder 22 is arranged to rotate the wedging member 21 relative to the rim member 4 in the other rotation direction and move the wedging member 21 backwards B in direction of said rotational axis X guided by the threaded engagement between the rim member 4 and the wedging member 21, thereby releasing said wedging and making way for the rim member 4 to move radially towards said rotational axis X. Relative rotation between the wedging member 21 and the rim member 4 could alternatively be implemented using a motor, such as an electric motor as described referring to FIG. 7.

In the embodiment of FIGS. 8*a*-8*b*, the actuator 22, i.e. the hydraulic cylinder 22 can move the wedging member 23 by screwing. In the embodiment illustrated in FIGS. 8*a* and 8*b*, the adjustment is implemented using two wedging members 21. Particularly, said adjusting means 20 comprises two of said wedging members 21 rotatable by the actuator 22 relative to the rim member 4, and movable in direction of said rotational axis X simultaneously towards each other both simultaneously wedging the rim member 4 radially outwards from said rotational axis X and/or simultaneously away from each other both simultaneously releasing said wedging and making way for the rim member 4 to move radially towards said rotational axis X. The slanted and threaded radially outer side portion of each of the wedging members 21 then meshes with a slanted and threaded radially inner side portion of a rim member 4 of the adjustable rim arrangement 4*a*. These two wedging members 21 (including the threads and slanting shape) and parts of the rim member 4 that they contact (including the threads and slanting shape of the rim member), are then mirror shaped with respect to the rotation plane of the drive sheave body 3 (the plane p in FIG. 8*a* to which the axis X is normal), which also parallel to the rotation planes of the wedging members 21. Thereby, when the two wedging members 21 are rotated together in one direction relative to the rim member 4, they are at the same time screwed along the threads of the rim member 4 such that they move towards each other (each moving in direction F), and when they are rotated relative to the rim member 4 together in the other direction they are screwed along the threads of the rim member 4 such that they move away each other (each moving in direction B). The actuator 22 is preferably immovably or at least substantially immovably mounted on the drive sheave body 3.

In the embodiment illustrated in FIGS. 8*a* and 8*b*, the drive sheave 1 moreover comprises a synchronizing means 24*a*, preferably at least one synchronizing member 24*a*, for synchronizing rotation of the aforementioned two wedging members 21. It is arranged to allow relative movement between the two wedging members 21 in direction of said rotational axis X and block relative rotation between the wedging members 21. The synchronizing member 24*a* can be for instance a bar oriented parallel with rotational axis X its one end extending in a hole formed in one of the two wedging members 21 and its other end extending in a hole formed in the other one of the two wedging members 21, wherein said hole is also oriented parallel with the rotational axis X.

In the embodiment FIG. 9, the wedging member 31 has plurality of radially (i.e. in radial direction of the rotational axis X) outer side portions which are slanted, in particular to have a first end and a second end displaced in tangential direction of the rotational axis X, which ends are at different distances from the rotational axis X, said wedging member 31 being movable against a radially (i.e. in radial direction of the rotational axis X) inner side of the rim member 4 for wedging the rim member 4 radially outwards from said rotational axis X.

In FIG. 9, the structure when in line with FIG. 5 has been shown. By broken lines the seams between consecutive rim members 4 have been drawn to illustrate the structure when in line with FIG. 6.

The aforementioned single rim member 4 or the rim members 4 of the array together (as described referring to FIG. 6) of the adjustable rim arrangement 4*a* comprise(s) plurality of radially inner side portions which face the slanted radially outer side portion of the wedging member 31 and are also slanted, in particular to have a first end and a second end displaced in tangential direction of the rotational axis X, which ends are at a different distances from the rotational axis X.

The wedging member 31 is movable relative to the rim member 4 or the rim members 4 of the array in tangential direction of said rotational axis X forward F for wedging the rim member(s) 4 radially outwards from said rotational axis X, and backwards B for releasing said wedging and for making way for the rim member 4 to move radially towards said rotational axis X, and the actuator 32 is arranged to actuate movement of the wedging member 31 in forward and backwards direction F,B. In the preferred embodiment, said actuator 32 is a hydraulic cylinder connected with the wedging member 31 and the drive sheave body. The aforementioned rim member 4 or the rim members 4 of the array are completely or at least substantially unrotatable around the rotational axis X relative to the drive sheave body 3, whereby relative movement can be ensured.

One of the extension and retraction of the hydraulic cylinder 32 is arranged to rotate the wedging member 31 relative to each said rim member 4 in one rotation direction and move it forward F in tangential direction of said rotational axis X thereby wedging each said rim member 4 radially outwards from said rotational axis X. The other of the extension and retraction of the hydraulic cylinder 32 is arranged to rotate the wedging member 31 relative to each said rim member 4 in the other rotation direction and move the wedging member 31 backwards B in direction of said rotational axis X thereby releasing said wedging and making way for each said rim member 4 to move radially towards said rotational axis X. Relative rotation between the wedging member 31 and the rim member 4 or the array of them around the rotational axis could alternatively be implemented using a motor, such as an electric motor as described referring to FIG. 7.

FIG. 10 illustrates a preferred alternative embodiment wherein the diameter adjustment is implemented by screwing. In this embodiment, the adjusting means 40 comprises, preferably per each said adjustable rim arrangement 4A, a screwing means 41*a*-41*d* actuatable to push the rim members 4 of the adjustable rim arrangement 4A (i.e. the aforementioned single rim member 4 or more than one rim members 4 together defining said circular outer rim 5 of the adjustable rim arrangement 4A) radially outwards from said rotational axis X. The screwing means 41*a*-41*d* actuatable are moreover actuatable to release said push. The adjusting means 40 moreover comprises an actuator 42 for actuating the screwing means 41*a*-41*d*.

In the drive machinery M of FIG. 10, the actuator 42 is preferably an electric motor, and rotation, preferably rotation speed and/or rotation direction, of the motor 42 is electrically controllable. The actuator 42 is illustrated in FIG. 10 with broken line. The actuator 42 is preferably fixedly mounted on the drive sheave body 3.

In the drive machinery M of FIG. 10, the screwing means 41*a*-41*d* comprises screws 41*c* rotatable by said actuator 42. Each said screw 41*c* is rotatable in two rotation directions by said actuator 42 around an axis a extending in radial direction of the rotational axis X. The axis a has been illustrated only for one of the screws 41*c*. The rotational axis of the motor 42 is parallel with said rotational axis X. The actuator 42 is arranged to rotate each of said screws 41*c* via a bevel gear mechanism 41*a*,41*b*.

Each said screw 41*c* is arranged to push a rim member 4 radially outwards from said rotational axis X when rotated by the actuator in one rotation direction, and to release said push and make way for the rim member 4 to move radially back towards said rotational axis X when rotated by the actuator in the other rotation direction.

Said actuator 42 is arranged to rotate each said screw 41*c* inside a threaded opening 41*d* provided on the drive sheave body 3, or alternatively an element mounted fixedly thereon, in one rotation direction for pushing a rim member 4 radially outwards from said rotational axis X, and in the other rotation direction for releasing said push and for making way for the rim member 4 to move radially back towards said rotational axis X. Said releasing and making way may include also pulling the rim member 4 to move radially back towards said rotational axis X.

Figure 11:
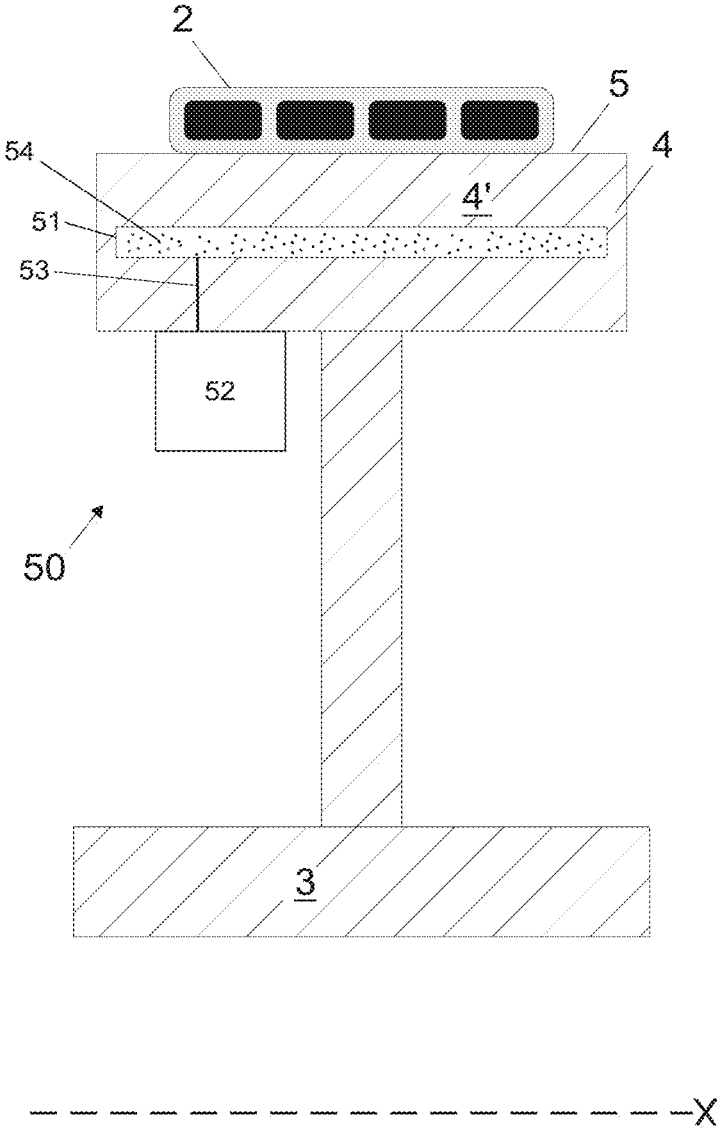
FIG. 11 illustrates preferred details of a fifth kind for the drive machinery of FIG. 1.

FIG. 11 illustrates a preferred alternative embodiment wherein the diameter adjustment is implemented by hydraulically deforming the rim member(s) of each adjustable rim arrangement 4A. In this embodiment, each of the rim members 4 (i.e. the aforementioned single rim member 4 or the aforementioned more than one rim members 4 together defining said circular outer rim 5 of an adjustable rim arrangement 4A) comprises a hydraulic chamber 51 containing hydraulic fluid 54, and a radially outer wall 4' of the hydraulic chamber, the radially outer wall 4' in particular bordering the hydraulic chamber 51 on the radially outer side thereof, the shape of which radially outer wall 4' is elastically deformable. The adjusting means 50 comprises a pressure adjusting system 52,53 for adjusting the fluid pressure, in particular increase or relieve the fluid pressure, in the hydraulic chamber 51 of the rim member 4. The pressure adjusting system 52,53 can for instance comprise a pressurizing device 52 (schematically shown), such as a hydraulic pump or a hydraulic cylinder connected by at least one fluid channel 53 with each hydraulic chamber 51 of the adjustable rim arrangement 4A. The pressure adjusting system 52,53 can possibly also comprise valves for controlling fluid flow and/or fluid pressure.

The pressure adjusting system 52,53 is operable to increase the fluid pressure in said hydraulic chamber 51 such that the radially outer wall 4' bulges radially outwards from said rotational axis X, as well as to relieve said pressure, in particular such that the radially outer wall 4' retracts from a bulging state radially back towards said rotational axis X.

Figure 12:
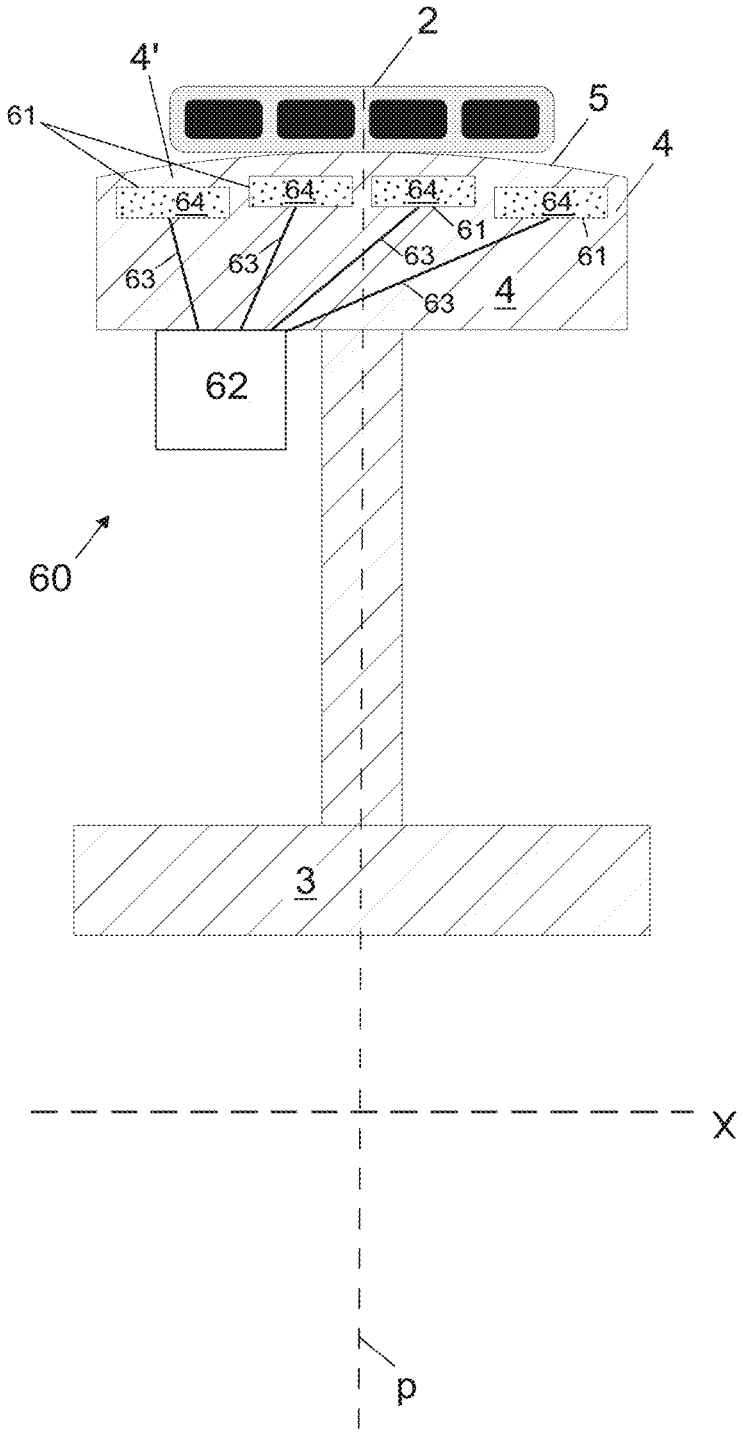
FIG. 12 illustrates preferred details of a sixth kind for the drive machinery of FIG. 1.
Figure 13:
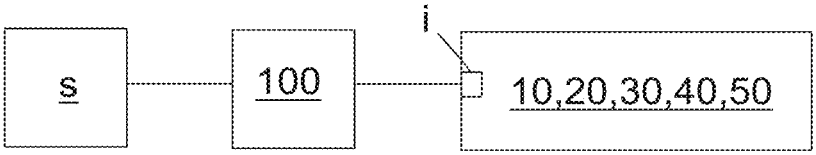
FIG. 13 illustrates preferred details connections between parts of an elevator.

FIG. 12 illustrates another preferred alternative embodiment wherein the diameter adjustment is implemented by hydraulically deforming the rim member(s) 4 of each adjustable rim arrangement 4A. In this embodiment, each of the rim members 4 (i.e. the aforementioned single rim member 4 or the more than one rim members 4 together defining said circular outer rim 5) of an adjustable rim arrangement 4A comprises plurality of hydraulic chambers 61 containing hydraulic fluid 64, and a radially outer wall 4' of the hydraulic chamber, the radially outer wall 4' in particular bordering the hydraulic chambers 61 on the radially outer side thereof, the shape of which radially outer wall 4' is elastically deformable, and a pressure adjusting system 62,63 for adjusting fluid pressures in the hydraulic chambers 61 of the rim member 4 of the adjustable rim arrangement 4A. The pressure adjusting system 62,63 can for instance comprise a pressurizing device 62 (schematically shown), such as a hydraulic pump or a hydraulic cylinder connected by at least one fluid channel 63 with each hydraulic chamber 61 of the adjustable rim arrangement 4A. The pressure adjusting system 62,63 can possibly also comprise valves for controlling fluid flow and/or fluid pressure.

The pressure adjusting system 62,63 is operable to increase the fluid pressure in each of the hydraulic chambers 61 of a rim member 4 such that the radially outer wall 4' bulges radially outwards from said rotational axis X, as well as to relieve said pressure, in particular such that the radially outer wall 4' retracts from a bulging state radially back towards said rotational axis X.

The aforementioned plurality of hydraulic chambers 61 of a rim member 4 are preferably beside each other in direction of said rotational axis X, as illustrated in FIG. 12.

The fluid pressures in the hydraulic chambers 61 of the rim member 4 are preferably adjustable to differ from each other.

For facilitating adjustability of the fluid pressures in the hydraulic chambers 61 of the rim member 4 to differ from each other, in the preferred embodiment, fluid pressures in the plurality of hydraulic chambers 61 are individually adjustable by the pressure adjusting system 62,63, i.e. the pressure adjusting system 62,63 can adjust the fluid pressure, in particular increase or relieve the fluid pressure, in each of the hydraulic chambers 61 of the rim member 4 without changing fluid pressures in the other hydraulic chambers (61) of the rim member 4.

For facilitating adjustability of the fluid pressures in the hydraulic chambers 61 of the rim member 4 to differ from each other, in the preferred the pressure adjusting system 62,63 preferably comprises fluid channels 63 separately connected with the hydraulic chambers 61 of the rim member 4 for enabling adjusting the fluid pressures in the hydraulic chambers 61 of the rim member 4 to differ from each other.

The above mentioned adjustability of the fluid pressures in the hydraulic chambers 61 of the rim member 4 to differ from each other provides an additional advantage that the profile of the rim member 4 can be adjusted to control the position of the rope 2 in direction of the rotational axis X. The amount of camber of the profile of the rim member 4 can be increased or decreased by which camber the rope can be guided in direction of said rotational axis X towards the peak of the convex shaped profile. Asymmetry of the profile of the rim member 4 relative to plane of rotation p of the drive sheave body 3 can also be increased or decreased, by which asymmetry the rope can be guided towards a desired location in direction of said rotational axis X.

In the embodiments of FIGS. 11 and 12, the drive sheave 1 can have a hydraulic pressurizing device 52,62 per each said adjustable rim arrangement 4A, but this is not necessary since hydraulic pressure can be shared for implementing adjustment of more than one adjustable rim arrangements 4A, particularly since it is possible to pressurize a fluid by a single pressurizing device, such as a pump or a hydraulic cylinder, and to connect the fluid with plurality of hydraulic chambers, and to use control valves between the pressurizing device and each hydraulic chamber which control valves are adjustable to reduce the fluid pressure individually.

As mentioned above, the diameter of the rim 5 of one or more of said rim arrangements 4A is individually adjustable for enlarging or reducing the turning radius of a rope 2 passing around the rim 5 in question. Most preferably, the diameter of the rim 5 of more than one, possibly all or all but one, of said plurality of rim arrangements 4A is individually adjustable for enlarging or reducing the turning radius of a rope 2 passing around the rim 5 in question. The drive machinery M can for instance comprise 2, 3, 4, 5, 6, 7, 8, 9 or 10 rim arrangements 4A, and the diameter of the circular outer rim 5 of all or all but one of these rim arrangements 4A is individually adjustable for enlarging or reducing the turning radius of a rope 2 passing around the circular outer rim 5 in question.

In the preferred embodiments, the motor m is connected with the drive sheave body 3, preferably directly or via transmission, such that the motor m can rotate the drive sheave body 3. The drive sheave body 3 is preferably either directly fixed to or integral with the rotor r of the motor m. Alternatively, there could be a force transmission, such as gears, between the motor m and the drive sheave body 3. Said adjusting means 10,20,30,40,50,60 are preferably mounted on the drive sheave body 3 such that they are rotatable together with the drive sheave body 3 around said rotational axis X.

Generally, said releasing (i.e. releasing of the wedging and/or the push) and making way may for a rim member 4 to move radially towards said rotational axis X may include also pulling the rim member 4 to move radially back towards said rotational axis X. This can be simply implemented by mechanically connecting parts to each other radially immovably or at least substantially immovably. For example, this can be implemented by mechanically connecting the wedging means 11,21,31, such as the wedging member 11,21,31 thereof, radially immovably or at least substantially immovably to the rim member 4 or by mechanically connecting the screwing means, such as the screw 41*c* thereof, radially immovably or at least substantially immovably to the rim member 4.

The elevator is preferably such that it comprises a tension sensing means s for sensing individual tensions of one or more of the ropes 2, and the elevator is arranged to adjust with said adjusting means 10,20,30,40,50,60 the diameter of the circular outer rim 5 of at least one adjustable rim arrangement 4A based on the sensed individual tensions 2. As illustrated in FIG. 3 said tension sensing means can comprise a force sensor s between the elevator car c and an end of a rope 2 fixed to the elevator car c for sensing individual tension of said rope 2 and/or a force sensor between the counterweight and an end of a rope fixed to counterweight for sensing individual tension of said rope 2. In a 2:1 solution, the force sensor(s) s would preferably be between an end of a rope fixed to a stationary fixing base (e.g. stationary structure of the building) on the elevator car c side for sensing individual tension of said rope 2 and/or between an end of a rope fixed to a stationary fixing base (e.g. stationary structure of the building) on the counterweight side for sensing individual tension of said rope 2. There are of course also alternative ways to measure tension of an individual rope.

Preferably, the elevator is more particularly arranged to sense individual tensions of one or more of the ropes 2 and compare the sensed individual tensions with one or more reference tensions and to adjust by said adjusting means 10,20,30,40,50,60 the diameter of the circular outer rim 5 of at least one adjustable rim arrangement 4A based on the sensed individual tensions 2, in particular such that a difference between a measured tension and a reference tension is reduced.

Said one or more reference tensions can comprises a preset tension or an average tension of measured individual tensions of plurality of ropes or a measured individual tension of one of the other ropes of the elevator, for example.

Figure 14A:
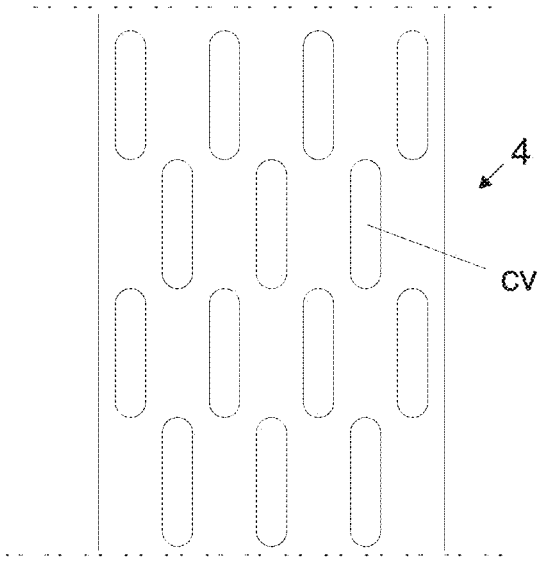
FIGS. 14*a* and 14*b* illustrate preferred details for facilitating deformation of a rim member of an adjustable rim arrangement particularly to be used in an embodiment in accordance with FIG. 5.
Figure 14B:
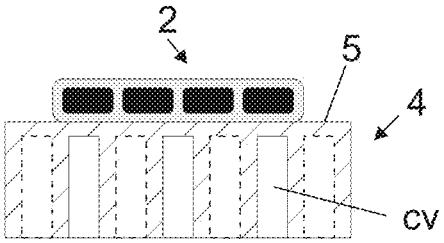

As earlier above mentioned, in the solution presented in FIG. 5, the adjustable rim arrangement 4A comprises a single rim member 4 defining said circular outer rim 5. In this case, the one rim member 4 defining said circular outer rim 5 is deformable to have different diameters, which can be implemented by resilient material and/or structure. The deformability of the circular outer rim 5 to have different diameters can be facilitated structurally for instance by providing the rim member(s) of an adjustable rim arrangement 4A with plurality of cavities cv as illustrated in FIGS. 14*a* and 14*b*. In these Figures, preferred although not necessary further features are presented, namely that the rim member 4 comprises cavities cv. In the presented case, the rim member 4 comprises plurality of cavities cv side by side in the rotational direction X distributed along the rim 5 in tangential direction thereof. In the presented case, the cavities are elongated and oriented in tangential direction of the rim 5.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A drive machinery for an elevator, the drive machinery comprising:

a rotatable drive sheave configured to drive a plurality of ropes of the elevator, and a motor configured to rotate the rotatable drive sheave, wherein the rotatable drive sheave includes, a drive sheave body rotatable around a rotational axis, a plurality of rim arrangements mounted on the rotatable drive sheave body side-by-side in direction of said rotational axis, the plurality of rim arrangements defining circular outer rims for transmitting traction to a rope, the circular outer rims being coaxial with each other, the plurality of rim arrangements each including at least one rim member, and an adjusting device including a wedge and an actuator, the actuator configured to actuate the wedge radially against the at least one rim member to adjust diameters of each of the circular outer rims individually to enlarge or reduce a turning radius of a respective one of the plurality of ropes that pass therearound without changing the diameters of other ones of the circular outer rims.

2. The drive machinery according to claim 1, wherein the adjusting device is configured to individually adjust the diameter of a respective one of the circular outer rims relative to the diameters of the other ones of the circular outer rims.

3. The drive machinery according to claim 1, wherein the adjusting device is mounted on the rotatable drive sheave body such that the adjusting device is rotatable together with the rotatable drive sheave body around the rotational axis.

4. The drive machinery according to claim 1, wherein the adjusting device is electrically controllable.

5. The drive machinery according to claim 1, wherein the adjusting device is configured to change a position of the at least one rim member defining the respective one of the circular outer rims in a radial direction of said rotational axis.

6. The drive machinery according to claim 1, wherein the wedge is in a radial direction between the rotational axis and the at least one rim member of a respective one of the plurality of rim arrangements, the wedge is movable relative to the at least one rim member forward for wedging the at least one rim member radially outwards from said rotational axis, and backwards for releasing said wedging and for making way for the at least one rim member to move radially towards said rotational axis, and the actuator is configured to actuate movement of the wedge forward and backwards.

7. The drive machinery according to claim 1, wherein the actuator is an electric motor or a hydraulic cylinder.

8. The drive machinery according to claim 7, wherein said actuator is the electric motor, the electric motor configured to, rotate in one direction to move the wedge forward in first direction of said rotational axis, and rotate an opposite direction to move the wedge backwards in second direction of said rotational axis.

9. The drive machinery according to claim 1, wherein the wedge includes a pair of wedges, the actuator configured to move the pair of wedges in a direction of said rotational axis simultaneously towards each other to simultaneously wedge a rim member radially outwards from said rotational axis, and move the pair of wedges in the direction of said rotational axis simultaneously away from each other to simultaneously release said wedging and making way for a rim member to move radially towards said rotational axis.

10. The drive machinery according to claim 1, wherein each of the at least one rim member has a threaded radially inner side portion which is slanted and meshes with a threaded slanted radially outer side portion of the wedge, and the wedge is rotatable by the actuator relative to the at least one rim member.

11. An elevator comprising:

the drive machinery as defined in claim 1, and the plurality of ropes arranged to pass around the rotatable drive sheave thereof while resting on a circular outer rim of one of the plurality of rim arrangements of the rotatable drive sheave.

12. The elevator according to claim 11, wherein the elevator further comprises:

a tension sensor configured to sense individual tensions of one or more of the ropes, wherein the adjusting device is configured to adjust the diameter of the circular outer rim of at least one of the plurality of rim arrangements based on the individual tensions sensed by the tension sensor.

13. A rotatable drive sheave configured to drive a plurality of ropes of an elevator, the rotatable drive sheave comprising:

a drive sheave body rotatable around a rotational axis;

a plurality of rim arrangements mounted on the rotatable drive sheave body side-by-side in a direction of said rotational axis, the plurality of rim arrangements defining circular outer rims for transmitting traction to a rope, the circular outer rims being coaxial with each other, the plurality of rim arrangements each including at least one rim member; and an adjusting device including a wedge and an actuator, the actuator configured to actuate the wedge radially against the at least one rim member to adjust diameters of each of the circular outer rims individually to enlarge or reduce a turning radius of a respective one of the plurality of ropes that pass therearound without changing the diameters of other ones of the circular outer rims.

* * * * *